United States Patent [19]

Guinter

[11] Patent Number: 4,874,148

[45] Date of Patent: Oct. 17, 1989

[54] UNIVERSAL DISPLAY BRACKET

[75] Inventor: S. R. Guinter, Rockford, Ill.

[73] Assignee: Newell Co., Freeport, Ill.

[21] Appl. No.: 248,276

[22] Filed: Sep. 21, 1988

Related U.S. Application Data

[63] Continuation of Ser. No. 936,206, Dec. 12, 1986, abandoned.

[51] Int. Cl.[4] ..... F16L 3/08

[52] U.S. Cl. ..... 248/225.2; 248/227; 248/231.9

[58] Field of Search ..... 248/225.2, 227, 220.2, 248/222.2, 223.3, 231.9, 300, 315, 243, 245, 251; 211/191, 192, 193; 403/346, 372

[56] References Cited

U.S. PATENT DOCUMENTS

| | | | |
|---|---|---|---|
| 3,759,297 | 9/1973 | Anderson et al. | 248/243 X |
| 4,154,419 | 5/1979 | Breidenbach | 211/192 X |
| 4,189,123 | 2/1980 | Johnson | 248/220.2 |
| 4,205,815 | 6/1980 | Sauer et al. | 248/243 |
| 4,316,546 | 2/1982 | Varon et al. | 248/251 X |
| 4,455,007 | 6/1984 | Varon et al. | 248/251 |
| 4,535,704 | 8/1985 | Suttles | 248/243 X |

*Primary Examiner*—Ramon O. Ramirez

*Attorney, Agent, or Firm*—James G. Staples; David I. Roche

[57] ABSTRACT

A display bracket especially adapted for supporting retail merchandising crossbars is disclosed which is capable of mounting crossbars to display uprights which have varying (a) sizes of apertures and (b) spacings of apertures in the uprights, said display bracket including a bracket having two rearwardly projecting protrusion members, one of which has a hook-like element and one of which does not. A wedge option for eliminating looseness and a friction lock for providing further stability is also disclosed.

8 Claims, 1 Drawing Sheet

UNIVERSAL DISPLAY BRACKET

This application is a continuation of application Ser. No. 936,206, filed Dec. 12, 1986, now abandoned.

FIELD OF THE INVENTION

This invention relates to a display bracket and crossbar assembly for use with any one of a variety of retail display uprights. More particularly, the display bracket can quickly and easily secure a display crossbar to display uprights in systems having differing slot spacings and thereby provide hanging space for retail merchandise with little regard for the slot spacings from display upright to display upright.

BACKGROUND OF THE INVENTION

Retail merchandise displays in general have been known for some time. These displays often use display uprights as their primary means of support. Display uprights are typically square metal tubes which are usually bolted in vertical fashion to store walls or similar-type structures. These uprights typically have uniformly spaced apertures which are typically used to "hook-in" shelving supports or similar "connecting hardware". Since display uprights are usually secured to solid structures, they are often difficult and expensive to replace. Consequently once the uprights are installed, a retail store will usually resist replacing them.

Unfortunately, display hardware manufacturers have typically developed their own designs and have failed to agree upon a standardized display upright. Indeed, a display upright from one producer is often not compatible with connecting hardware from another producer. In particular, the height of the slots and the vertical spacing of slots vary widely between different display upright manufacturers.

This lack of uniformity in the retail display hardware industry has created problems for some retailers and retail suppliers. A retail supplier will sometimes be unable to develop a uniform low cost retail display campaign which uses connecting hardware, because the connecting hardware to be used may not be compatible with all types of display uprights used in retail stores.

As a solution, retail suppliers could provide their own display uprights for installation. However, this would be costly and inconvenient; furthermore, many retail stores prefer to use their own previously installed uprights. Alternatively, retail suppliers could obtain compatible connecting hardware for each upright design they encounter; however, this would also be costly and inconvenient.

Consequently, it is an object of this invention to create a simple and inexpensive universal display bracket and crossbar assembly which can be used as connecting hardware for any one of a variety of display uprights and particularly display uprights having differing slot spacings.

A further object of this invention is to create a universal display bracket and crossbar assembly which is easy to use, durable, and inexpensive to manufacture.

Other objects and features of the invention will become apparent to those skilled in the art from the following specification when read in the light of the annexed drawing.

SUMMARY OF THE INVENTION

The universal display bracket and crossbar assembly of this invention can be releasably secured to any one of a variety of known display uprights. In use, two brackets typically support a display crossbar to create a rack for displaying retail products. Typically, the bracket and crossbar combination can be quickly and easily attached to and detached from a typical display upright. Moreover, the bracket and crossbar assembly is reliable, durable, and inexpensive to manufacture.

DESCRIPTION OF THE DRAWINGS

The preferred embodiment of this invention is illustrated more or less diagrammatically in the accompanying drawing wherein.

DESCRIPTION OF THE PREFERRED EMBODIMENT

Like reference numbers will be used to refer to like parts from Figure to Figure in the following description of the preferred embodiment of the invention.

The display bracket of this invention is designed to secure a typical retail display crossbar to any one of a number of known display uprights. In supporting the crossbar, the brackets are typically used in pairs having a left hand bracket, as shown in FIG. 1, and a "mirror image" right hand bracket, not illustrated.

The bracket is typically made from ordinary 14 gauge sheet metal and provided with a chrome plate finish to not only protect the bracket from corrosion, but also give the bracket a more pleasant appearance.

Figure 1:
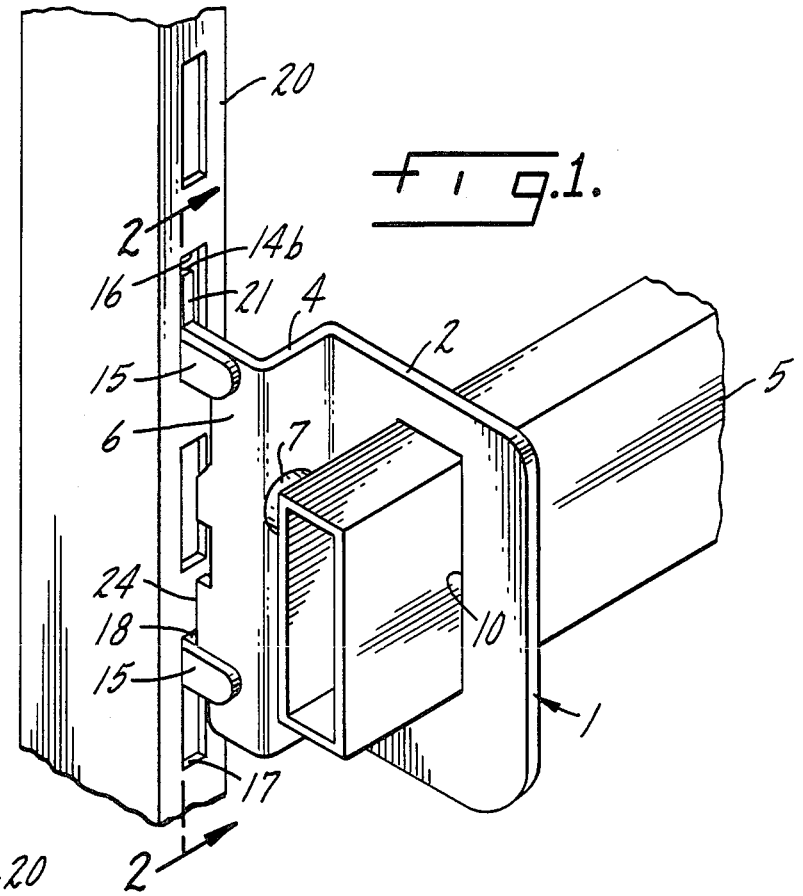
FIG. 1 is a perspective view disclosing the universal display bracket as it would typically appear when installed in a retail store.

The bracket is indicated generally at 1 in FIG. 1. As can be seen in this figure, the bracket body includes a front end portion 2, an offset middle portion 4, and a rear end portion 6. The planes of end portions 2 and 6 are generally parallel to each other and generally perpendicular to the plane of offset middle portion 4.

Front end portion 2 has an aperture 3 through which a crossbar 5 can be inserted as illustrated in FIG. 1. The aperture in the preferred embodiment may be about ½ inch wide and about 1½ inches high and accommodates a common retail display crossbar of slightly smaller dimensions.

Figure 2:
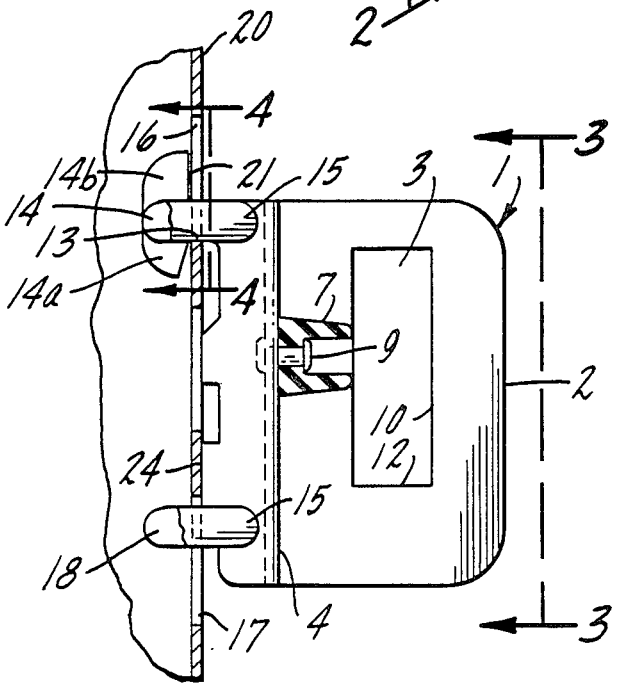
FIG. 2 is a view taken substantially along the line 2—2 of FIG. 1 with parts broken away for clarity.

When inserted, crossbar 5 presses against friction lock 7. As illustrated in FIG. 2, this friction lock is a synthetic rubber protrusion which extends from offset middle portion 4. Friction lock 7 is fastened to middle portion 4 by recessed fastener 9.

Figure 3:
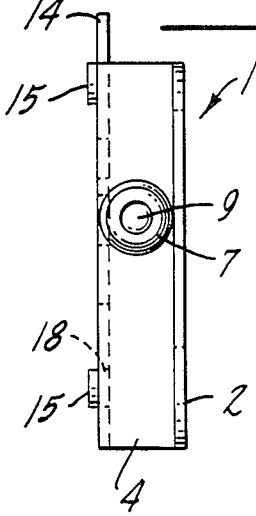
FIG. 3 is a view taken substantially along the line 3—3 of FIG. 2.

As can be seen in FIG. 3, friction lock 7 protrudes perpendicularly from middle portion 4 and has a circular outer surface of continuously decreasing diameter as the friction lock protrudes from the bracket. The recessed center portion allows fastener 9 to secure friction lock 7 to the bracket without interfering with the contacting relationship between friction lock 7 and crossbar 5. Friction lock 7 is compressible; indeed it preferably has the characteristics with respect to flexibility and memory retention of rubber. It has sufficient rigidity to maintain its original shape upon removal of the compression force by crossbar 5 and is also sufficiently rigid to resist wear due to the pushing in and pulling out of crossbar 5.

Friction lock 7 presses against crossbar 5, creating friction not only between the friction lock and crossbar, but also between the crossbar and forward side edge 10 of aperture 3 as shown in FIG. 1. Friction lock 7 causes crossbar 5 to have a snug friction fit within aperture 3, and the crossbar and bracket combination will therefore resist vibration, wobbling, and unintentional disassembly. In addition to friction lock 7, gravitational forces create further friction between crossbar 5 and bottom boundary edge 12 of aperture 3 and therefore further secures the crossbar within the aperture.

The spacing between any two display uprights is usually not critical, because the friction lock of this bracket will secure the crossbar within the bracket aperture typically at any point along the length of the crossbar.

As further illustrated in FIGS. 1 and 2, the bracket has a connecting and locking member projecting rearwardly from the upper portion of the bracket body. The connecting and locking member includes a shank 14 which has retaining portion **14*a* extending downwardly from the shank at the distal end portion thereof. It will be noted that the retaining portion 14*a* is spaced from the bracket body a distance greater than the thickness of the material from which the upright is formed. A retainer 14*b* extends vertically upwardly at said distal end portion of the shank. A stabilizing member 18 projects rearwardly from the bracket body at a location beneath the shank. It will be noted that the stabilizing member 18 has a vertical height substantially less than the vertical height of the slot 17 in which it is received. The connecting and locking member 14 and stabilizing member 18 thereby secure the bracket to the display upright 20**. In the preferred embodiment, these inserts are about two inches apart from each other.

Figure 4:
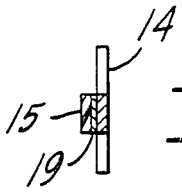
FIG. 4 is a view taken substantially along the line 4—4 of FIG. 2.

Because the upright apertures are typically wider than the width of the bracket inserts, cushion spacers 15 may be added. As shown in FIG. 4, these cushion spacers have a pressure sensitive adhesive 19 on the side contacting the bracket inserts. These cushion spacers are preferably made of a compressible synthetic such as styrene and are about 0.06 inches thick.

If necessary, numerous spacers may be used. The spacers may be combined by applying the adhesive side of the added spacer to the non-adhesive side of the previously applied spacer. The spacers are compressible and therefore should be applied to the bracket inserts in sufficient number to create a combined spacer and bracket width which is slightly wider than the upright aperture into which the combination will be inserted. The combined spacer and bracket insert can then be squeezed into their respective upright apertures during bracket installation. Once in place, the cushioned inserts will typically create a snug fit which substantially diminishes twisting or wobbling by the bracket.

The display bracket is installed by first pushing the bracket's upper rearwardly protruding connecting and locking member insert 14 into upper aperture 16, top portion first. The bracket is then pulled upward while pivoting the stabilizing member 18 into lower aperture 17. The bracket is then pushed downward, hooking the upper retaining portion **14*a* over the lower boundary 13 of aperture 16. By hooking over this lower aperture boundary, the connecting and locking members insert 14 will not pivot back out of aperture 16 unless the bottom of the bracket is pivoted forward, pulled upward, and then pulled outward. However, forces on the bracket during use will be primarily downward, and therefore the the connecting and locking insert 14 will typically remain hooked to the lower boundary of upper slot 16** during normal operation.

When the upper slot 16 has a sufficiently small height, upwardly extending retainer **14*b* of the connecting and locking member insert 14 will engage the upper boundary of slot 16, further securing the bracket to the upright 16** during use.

As shown in FIG. 1, when secured to a display upright, the bracket's rear middle edge 24 lies in a contacting relationship with the front surface of display upright 20. This contacting relationship between the bracket and upright prevents the bracket's lower portion from pivoting behind the display upright, causing the bracket to become unsteady and perhaps even disengage itself from the upright. To prevent middle rear edge 24 from sliding sideways off the upright front surface, insert stabilizing member 18 protrudes into lower display aperture 17.

The vertical spacing between the upright apertures is not critical. In use, the bracket's upper insert will hook the lower boundary of the upper aperture, and the bracket's lower insert need only protrude into the lower aperture; since the lower aperture height is typically much greater than the height of the bracket's lower insert, the position of lower aperture 17 relative to the upper aperture 16 may vary significantly, and the lower insert will still be able to protrude through the lower aperture. As already discussed, this lower insert may also have spacers to create a snug fit between stabilizing member 18 and the side boundaries of aperture 17.

Once engaged, the bracket will typically not be unintentionally disengaged by forces applied to the crossbar during normal use. The bracket can be disengaged by merely pulling the bracket upward, pivoting the bracket's lower portion away from the upright, and finally, pulling the bracket from the upright. Conversely, the bracket can once again be secured to the upright by tilting hook insert 14 into upper aperture 16, pivoting the bracket's lower portion rearwardly such that lower insert 18 protrudes into lower aperture 17, and finally pushing the entire bracket downward, hooking the bottom boundary of upper aperture 16 by hook insert 14.

This bracket is quite versatile. As discussed above, the bracket is able to accommodate significant differences in upright aperture spacing due to the relatively small lower insert 18 and relatively large upright apertures. The bracket also accommodates differences in upright aperture width by using cushioned spacers. Finally, differences in spacing between individual uprights are accommodated by using a friction lock in attaching the crossbar to the bracket.

The display bracket of this invention is durable, easy to use, and dependable. It provides retail merchandisers with an economical means for securing a common display crossbar to any one of a number of display uprights.

The foregoing description has been given for illustration purposes only. A wide range of changes and modifications can be made to the preferred embodiment described above. It should therefore be understood that it is the following claims, including all equivalents, which are intended to define the scope of this invention.

I claim:

1. A display bracket for use with a plurality of vertical slotted upright systems, one system having a slot spacing of a given distance and another system having a slot spacing different from the spacing in said one system, said display bracket including:

a bracket body, said bracket body being adapted, when assembled to a slotted upright, to project transversely outwardly from said slotted upright, means, carried by the bracket body, for securing the bracket to a slotted upright in any one of several slotted upright systems, all of which have dissimilar slot spacings, and for stabilizing the bracket, said bracket securing and stabilizing means comprising a connecting and locking member projecting rearwardly from the bracket body at a first location on the bracket body, and a stabilizing member projecting rearwardly from the bracket body at a second location on the bracket body, said second location being beneath said first location, said connecting and locking member having a shank adapted to penetrate a slot in a vertical upright and a retaining portion extending downwardly from the shank at the distal end portion thereof, said downwardly extending retaining portion being spaced from the bracket body a distance greater than the thickness of the slot material in a slotted upright with which it is adapted to be assembled, said stabilizing member having a vertical height less than the vertical height of a slot in which it is adapted to be received, said stabilizing member further being located beneath the shank of the connecting end locking member a distance sufficient to enable said stabilizing member to be received in a stabilizer receiving slot in each of variety of systems.

2. The display bracket of claim 1 further characterized in that said connecting and locking member further includes an upwardly extending retainer at the distal end portion of the shank, said upwardly extending retainer being engagable with the inside of a slotted upright when the shank is elevated above its normal position in which it rests on the bottom of a slot in a slotted upright.

3. The display bracket of claim 1 further including spacer means securable to the sides of the shank and the stabilizing member to reduce play between the shank and the stabilizing member, and the slots in which they are received.

4. The display bracket of claim 2 further including spacer means securable to the sides of the shank and the stabilizing member to reduce play between the shank and the stabilizing member, and the slots in which they are received.

5. In combination with a vertically slotted upright system, said system being one of a variety of systems each having slot spacings different from one another, a display bracket comprising a bracket body, said bracket body being adapted, when assembled o a slotted upright, to project transversely outwardly from said slotted upright, means, carried by the bracket body, for securing the bracket to a slotted upright in any one of several slotted upright systems, all of which have dissimilar slot spacings, and for stabilizing the bracket, said bracket securing and stabilizing means comprising a connecting and locking member projecting rearwardly from the bracket body at a first location on the bracket body, and a stabilizing member projecting rearwardly from the bracket body at a second location on the bracket body, said second location being beneath said first location, said connecting and locking member having a shank adapted to penetrate a slot in a vertical upright and a retaining portion extending downwardly from the shank at the distal end portion thereof, said downwardly extending remaining portion being spaced from the bracket body a distance greater than the thickness of the slot material in a slotted upright with which it is adapted to be assembled, said stabilizing member having a vertical height less than the vertical height of a slot in which it is adapted to be received, said stabilizing member further being located beneath the shank of the connecting end locking member a distance sufficient to enable said stabilizing member to be received in a stabilizer receiving slot in both said one system and said another system.

6. The display bracket of claim 5 further characterized in that said connecting and locking member further includes an upwardly extending retainer at the distal end portion of the shank, said upwardly extending retainer being engagable with the inside of a slotted upright when the shank is elevated above its normal position in which it rests on the bottom of a slot in a slotted upright.

7. The display bracket of claim 6 further including spacer means securable to the sides of the shank and the stabilizing member to reduce play between the shank and the stabilizing member, and the slots in which they are received.

8. The display bracket of claim 5 further including spacer means securable to the sides of the shank and the stabilizing member to reduce play between the shank and the stabilizing member, and the slots in which they are received.

* * * * *